US012350791B2

(12) United States Patent
Liu et al.

(10) Patent No.: US 12,350,791 B2
(45) Date of Patent: Jul. 8, 2025

(54) MESH ABRASIVE AND METHOD OF MAKING THE SAME

(71) Applicant: 3M INNOVATIVE PROPERTIES COMPANY, St. Paul, MN (US)

(72) Inventors: Yuyang Liu, St. Paul, MN (US); Junting Li, Woodbury, MN (US); Jaime A. Martinez, Kissimmee, FL (US)

(73) Assignee: 3M Innovative Properties Company, St. Paul, MN (US)

( * ) Notice: Subject to any disclaimer, the term of this patent is extended or adjusted under 35 U.S.C. 154(b) by 311 days.

(21) Appl. No.: 17/779,027

(22) PCT Filed: Dec. 2, 2020

(86) PCT No.: PCT/IB2020/061380

§ 371 (c)(1),
(2) Date: May 23, 2022

(87) PCT Pub. No.: WO2021/111327

PCT Pub. Date: Jun. 10, 2021

(65) Prior Publication Data

US 2023/0347474 A1 Nov. 2, 2023

Related U.S. Application Data

(60) Provisional application No. 62/944,894, filed on Dec. 6, 2019.

(51) Int. Cl.
*B24D 11/00* (2006.01)

(52) U.S. Cl.
CPC ..... *B24D 11/005* (2013.01); *B24D 11/008* (2013.01)

(58) Field of Classification Search
CPC ..... B24D 11/005; B24D 11/008
(Continued)

(56) References Cited

U.S. PATENT DOCUMENTS 35,570 A 6/1862 Sibley
4,314,827 A 2/1982 Leitheiser et al.
(Continued)

FOREIGN PATENT DOCUMENTS

EP 1015181 A1 * 7/2000 ..... B24D 11/00
EP 1015181 B1 3/2004
(Continued)

OTHER PUBLICATIONS

International Search Report for PCT International Application No. PCT/US2020/061380, mailed on Apr. 1, 2021, 5 pages.

*Primary Examiner* — James E McDonough
(74) *Attorney, Agent, or Firm* — Kathleen B. Gross; Bradford B. Wright

(57) ABSTRACT

A method of making a mesh abrasive product comprises sequentially: 1) providing a production tool having a mold surface defining a plurality of shaped cavities and filling at least some of the shaped cavities with an abrasive composite precursor slurry, wherein the abrasive composite precursor slurry comprises abrasive particles dispersed within a curable binder precursor; 2) contacting the mold surface with an open mesh backing comprising interwoven threads defining openings, and having first and second opposed major sides; 3) ultrasonically vibrating the abrasive composite precursor slurry; 4) curing the curable binder precursor by exposing it to sufficient actinic electromagnetic radiation to provide isolated shaped abrasive composites contacting and secured to the first major side of the open mesh backing; and 5)
(Continued)

separating the mesh abrasive product from the production tool. An open mesh abrasive product preparable by the method is also disclosed.

19 Claims, 4 Drawing Sheets

(58) Field of Classification Search
USPC ..... 51/293, 295
See application file for complete search history.

(56) References Cited

U.S. PATENT DOCUMENTS

| | | | |
|---|---|---|---|
| 4,623,364 | A | 11/1986 | Cottringer et al. |
| 4,652,274 | A | 3/1987 | Boettcher et al. |
| 4,652,275 | A | 3/1987 | Bloecher et al. |
| 4,744,802 | A | 5/1988 | Schwabel |
| 4,770,671 | A | 9/1988 | Monroe et al. |
| 4,799,939 | A | 1/1989 | Bloecher et al. |
| 4,881,951 | A | 11/1989 | Wood et al. |
| 4,903,440 | A | 2/1990 | Larson et al. |
| 5,152,917 | A | 10/1992 | Pieper et al. |
| 5,201,916 | A | 4/1993 | Berg et al. |
| 5,213,591 | A | 5/1993 | Celikkaya et al. |
| 5,236,472 | A | 8/1993 | Kirk et al. |
| 5,366,523 | A | 11/1994 | Rowenshorst et al. |
| 5,435,816 | A | 7/1995 | Spurgeon et al. |
| 5,437,754 | A | 8/1995 | Calhoun |
| 5,672,097 | A | 9/1997 | Hoopman |
| 5,714,259 | A | 2/1998 | Holmes et al. |
| 5,946,991 | A | 9/1999 | Hoopman |
| 5,975,987 | A | 11/1999 | Hoopman et al. |
| 5,984,988 | A | 11/1999 | Berg et al. |
| 6,129,540 | A | 10/2000 | Hoopman et al. |
| 6,406,577 | B1 | 6/2002 | Benedict et al. |
| 7,491,251 | B2 | 2/2009 | Welygan et al. |
| 8,034,137 | B2 | 10/2011 | Erickson et al. |
| 8,038,750 | B2 | 10/2011 | Pribyl et al. |
| 8,142,531 | B2 | 3/2012 | Adefris et al. |
| 8,142,532 | B2 | 3/2012 | Erickson et al. |
| 8,142,891 | B2 | 3/2012 | Culler et al. |
| 2003/0150169 | A1 | 8/2003 | Annen |
| 2003/0217516 | A1* | 11/2003 | Smith ..... A61Q 19/10 51/297 |
| 2009/0017727 | A1 | 1/2009 | Pribyl et al. |
| 2009/0163127 | A1 | 6/2009 | David et al. |
| 2009/0165394 | A1 | 7/2009 | Culler et al. |
| 2009/0169816 | A1 | 7/2009 | Erickson et al. |
| 2011/0065362 | A1 | 3/2011 | Woo et al. |
| 2012/0227333 | A1 | 9/2012 | Adefris et al. |
| 2013/0040537 | A1 | 2/2013 | Schwabel et al. |
| 2013/0125477 | A1 | 5/2013 | Adefris |
| 2015/0267097 | A1 | 9/2015 | Rosenflanz et al. |
| 2016/0354898 | A1 | 12/2016 | Nienaber et al. |

FOREIGN PATENT DOCUMENTS

| | | | | |
|---|---|---|---|---|
| FR | 923034 | A | 6/1947 | |
| WO | WO-2015071752 | A1 * | 5/2015 | ..... B24D 11/001 |
| WO | 2020165709 | A1 | 8/2020 | |

* cited by examiner

MESH ABRASIVE AND METHOD OF MAKING THE SAME

CROSS-REFERENCE TO RELATED APPLICATIONS

This application is a national stage filing under 35 U.S.C. 371 of PCT/IB2020/061380, filed Dec. 2, 2020, which claims the benefit of Provisional Application No. 62/944,894, filed Dec. 6, 2019.

TECHNICAL FIELD

The present disclosure broadly relates to methods of making mesh abrasives.

BACKGROUND

It is very common for dry sanding operations to generate a significant amount of airborne dust. To minimize this airborne dust, it is common to use abrasive discs on a tool while vacuum is drawn through the abrasive disc, from the abrasive side through the backside of the disc, and into a dust-collection system. For this purpose, many abrasives are available with holes converted into them, to facilitate this dust extraction. As an alternative to converting dust-extraction holes into abrasive discs, commercial products exist in which the abrasive is coated onto fibers of a net-type knit backing in which loops are knit into the backside of the abrasive article. The loops serve as the loop-portion of a hook-and-loop attachment system for attachment to a tool. Net type products are known to provide superior dust extraction and/or anti-loading properties, when used with substrates known to severely load traditional abrasives.

Structured abrasives have precisely-shaped abrasive features on a backing, and it has the advantage that the uniform islands wear at essentially the same rate such that a uniform rate of abrasion can be maintained for longer life. They are often made by filling mold cavities on a mold surface of a production tool with a slurry of abrasive particles in a curable binder precursor, contacting the filled tool with a backing, curing the slurry, and then separating the production tool from the backing and adhered shaped abrasive composites. Structured abrasive features disposed on net-type backings will be very useful for dust extraction sanding applications. However, challenge remains when coating a slurry on a very open net backing as the un-cured slurry may migrate to the backside of the net, contaminate the loop-portion of the net make the loop unusable for abrasive attachment or partially seal the openings in the net backing and comprise dust extraction efficiency. This invention provides mesh abrasive products having shaped abrasive composites secured to a mesh backing without extending through the mesh backing to its opposite side or without blocking the openings in the mesh backing between the shaped abrasive composites for dust extraction.

SUMMARY

Advantageously, methods according to the present disclosure can provide mesh abrasive products having shaped abrasive composites secured to a mesh backing without blocking the openings in the mesh backing between the shaped abrasive composites for dust extraction sanding. Moreover, methods according to the present disclosure can provide mesh abrasive products having shaped abrasive composites secured to a mesh backing with improved adhesion between the mesh backing and the shaped abrasive composites.

Accordingly, in one aspect, the present disclosure provides a method of making a mesh abrasive product, the method comprising sequentially:

- providing a production tool having a mold surface defining a plurality of shaped cavities;
- filling at least some of the shaped cavities with an abrasive composite precursor slurry, wherein the abrasive composite precursor slurry comprises abrasive particles dispersed within a curable binder precursor;
- contacting the mold surface with an open mesh backing comprising interwoven threads defining openings, and having first and second opposed major sides;
- ultrasonically vibrating the abrasive composite precursor slurry;
- curing the curable binder precursor by exposing it to sufficient actinic electromagnetic radiation to provide isolated shaped abrasive composites contacting and secured to the first major side of the open mesh backing; and
- separating the mesh abrasive product from the production tool.

In another aspect, the present disclosure provides a mesh abrasive product comprising:

- an open mesh backing comprising interwoven threads defining openings, and having first and second opposed major sides; and
- a plurality of isolated shaped abrasive composites contacting and secured to the first major side, wherein the isolated shaped abrasive composites comprise abrasive particles dispersed in an organic binder, and wherein the isolated shaped abrasive composites do not contact each other.

In a second aspect, the present disclosure provides a method of making a mesh abrasive product, the method comprising sequentially:

- providing a production tool having a mold surface defining a plurality of shaped cavities;
- filling at least some of the shaped cavities with an abrasive composite precursor slurry, wherein the abrasive composite precursor slurry comprises abrasive particles dispersed within a curable binder precursor;
- contacting the mold surface with an open mesh backing comprising interwoven threads defining openings, and having first and second opposed major sides;
- ultrasonically vibrating the abrasive composite precursor slurry;
- curing the curable binder precursor by exposing it to sufficient actinic electromagnetic radiation to provide isolated shaped abrasive composites contacting and secured to the first major side of the open mesh backing; and
- separating the mesh abrasive product from the production tool.

As used herein:

- the term "mesh" refers to a woven fabric formed by an individual curvilinear continuous interweaving made using one or more threads, which interweave binding by means of crossings, either horizontally or vertically;
- the term "open mesh" refers to a mesh having holes or openings of a size equal to 0.2 and 10 times the thread diameter; and
- the term "thread" includes threads and yarns.

Features and advantages of the present disclosure will be further understood upon consideration of the detailed description as well as the appended claims.

Figure 1A:
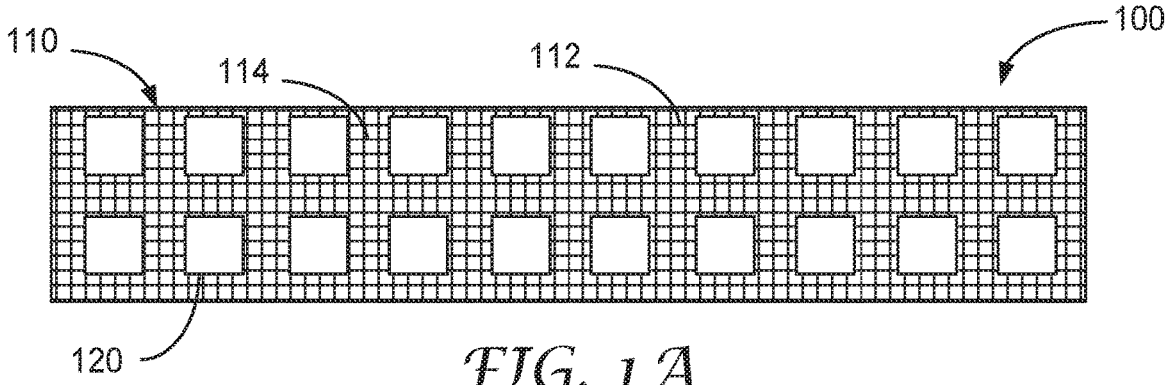
FIG. 1A is a schematic top view of exemplary mesh abrasive product according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Figure 1B:
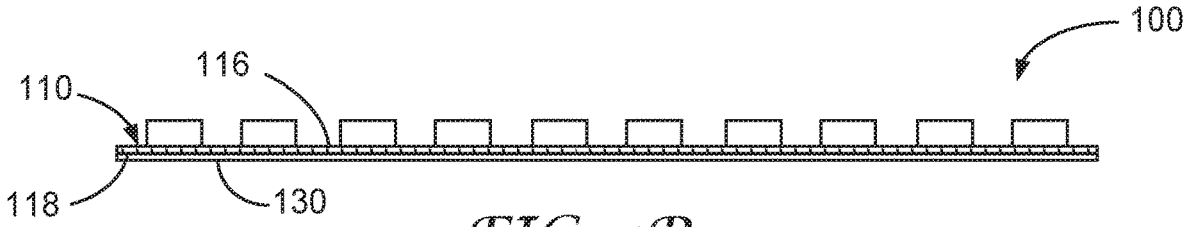
FIG. 1B is a schematic side view of mesh abrasive product 100 according to the present disclosure.
Figure 1C:
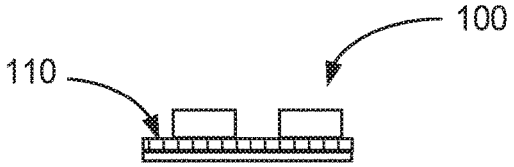
FIG. 1C is a schematic end view of mesh abrasive product 100 according to the present disclosure.

Referring now to FIGS. 1A-1C, exemplary mesh abrasive product 100 comprises an open mesh backing 110 comprising interwoven threads 112 defining openings 114, and having first and second opposed major sides 116, 118, respectively. A plurality of isolated shaped abrasive composites 120 contact and are secured to the first major side 116. The isolated shaped abrasive composites 120 comprise abrasive particles (not shown) dispersed in an organic binder (not shown). Isolated shaped abrasive composites 120 do not contact each other. Optional attachment layer 130 comprises either a looped portion or a hooked portion of a two-part hook and loop fastening system.

Any open mesh backing may be used. Examples include open woven, nonwoven, or knitted open synthetic and/or natural fiber meshes; open glass fiber mesh open metal fiber mesh; open molded thermoplastic polymer mesh; open molded thermoset polymer mesh; perforated sheet materials; and combinations thereof.

In some embodiments, the open mesh backing may be knitted or woven in a network having intermittent openings spaced along the surface of the scrim. The scrim need not be woven in a uniform pattern but may also include a nonwoven random pattern. Thus, the openings may either be in a pattern or randomly spaced. The openings may be rectangular or have other shapes including a diamond shape, a triangular shape, a hexagonal shape, or a combination of shapes; however, this is not a requirement.

The threads may have any diameter. In some preferred embodiments the threads have an average diameter of 10 to 1500 microns, preferably 100 to 1000 microns, and more preferably 50 to 500 microns. Likewise, the openings may have any size and/or shape. For example, the openings may have an average length and width that is 0.5 to 10 times the average diameter of the threads.

The term "shaped abrasive composite" refers to a composite structure comprising abrasive particles retained in a binder, wherein at least a major portion of the side and top surfaces, and optionally the base surface, have shapes at least substantially corresponding to a mold cavity used to form them. It is permissible for defects to be present that arise during the manufacturing process; for example, due to incomplete filling (resulting in irregular surface features) and/or overfilling (resulting in flash) of the mold cavities.

The shaped abrasive composites may have any shape and/or size. In some preferred embodiments the shaped abrasive composites have an average length and/or width of 30 to 5000 microns, preferably 100 to 3000 microns, and more preferably 500 to 2500 microns. Exemplary shapes may include at least one of triangular, square, rectangular, or hexagonal posts, pyramids, or truncated pyramids. Combinations of shaped abrasive composites may be used.

To ensure good adhesion of the shaped abrasive composites to the open mesh backing, the shaped abrasive composites may contact at least 2, at least 3, at least 4, at least five, at least 6, at least 7, at least 8, at least 12, or even at least 16 threads.

Exemplary organic binder precursors include curable (meth)acrylic compounds such as mono-, di-, tri-, and tetra-functional polymerizable acrylate monomers, (meth)acrylated urethanes, (meth)acrylated epoxies, ethylenically-unsaturated free-radically polymerizable compounds, aminoplast derivatives having pendant alpha, beta-unsaturated carbonyl groups, isocyanurate derivatives having at least one pendant acrylate group, and isocyanate derivatives having at least one pendant acrylate group) vinyl ethers, and mixtures and combinations thereof. As used herein, the term "(meth)acryl" encompasses acryl and/or methacryl.

(Meth)acrylated urethanes include di(meth)acrylate esters of hydroxyl-terminated isocyanate-extended polyesters or polyethers. Examples of commercially available acrylated urethanes include those available as CMD 6600, CMD 8400, and CMD 8805 from Cytec Industries, West Paterson, New Jersey.

(Meth)acrylated epoxies include di(meth)acrylate esters of epoxy resins such as the diacrylate esters of bisphenol A epoxy resin. Examples of commercially available acrylated epoxies include those available as CMD 3500, CMD 3600, and CMD 3700 from Cytec Industries.

Ethylenically-unsaturated free-radically polymerizable compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically-unsaturated free-radically polymerizable compounds typically have a molecular weight of less than about 4,000 g/mole and are typically esters made from the reaction of compounds containing a single aliphatic hydroxyl group or multiple aliphatic hydroxyl groups and unsaturated carboxylic acids, such as acrylic acid, methacrylic acid, itaconic acid, crotonic acid, isocrotonic acid, maleic acid, and the like. Representative examples of ethylenically-unsaturated free-radically polymerizable compounds include methyl methacrylate, ethyl methacrylate, styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl) isocyanurate, 1,3,5-tris(2-methyacryloxyethyl)-s-triazine, acrylamide, N-methylacrylamide, N,N-dimethylacrylamide, N-vinylpyrrolidone, and N-vinylpiperidone.

Useful aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho- and para-acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group and isocyanate derivatives having at least one pendant acrylate group are further described in U.S. Pat. No. 4,652,274 (Boettcher et al.). An example of one isocyanurate material is the triacrylate of tris(hydroxyethyl) isocyanurate.

Compounds that generate a free-radical source if exposed to actinic electromagnetic radiation (e.g., ultraviolet or visible electromagnetic radiation) are generally termed photoinitiators.

Examples of photoinitiators include benzoin and its derivatives such as α-methylbenzoin; α-phenylbenzoin; α-allylbenzoin; α-benzylbenzoin; benzoin ethers such as benzil dimethyl ketal, benzoin methyl ether, benzoin ethyl ether, benzoin n-butyl ether; acetophenone and its derivatives such as 2-hydroxy-2-methyl-1-phenyl-1-propanone and 1-hydroxycyclohexyl phenyl ketone; 2-methyl-1-[4-(methylthio)phenyl]-2-(4-morpholinyl)-1-propanone; and 2-benzyl-2-(dimethylamino)-1-[4-(4-morpholinyl)phenyl]-1-butanone. Other useful photoinitiators include, for example, pivaloin ethyl ether, anisoin ethyl ether, anthraquinones (e.g., anthraquinone, 2-ethylanthraquinone, 1-chloroanthraquinone, 1,4-dimethylanthraquinone, 1-methoxyanthraquinone, or benzanthraquinone), halomethyltriazines, benzophenone and its derivatives, iodonium salts and sulfonium salts, titanium complexes such as bis(.eta..sub.5-2,4-cyclopentadien-1-yl)-bis[2,6-difluoro-3-(1H-pyrrol-1-yl)phenyl]titanium; halonitrobenzenes (e.g., 4-bromomethylnitrobenzene), mono- and bis-acylphosphines. Combinations of photoinitiators may be used. One or more spectral sensitizers (e.g., dyes) may be used in conjunction with the photoinitiator(s), for example, in order to increase sensitivity of the photoinitiator to a specific source of actinic radiation.

The photoinitiator, if present, may be in any amount effective to cure the curable binder precursor. Typical amounts range from 0.1 percent to 5 percent, although greater and lesser amounts may also be used.

To promote an association bridge between the abovementioned binder and the abrasive particles, a silane coupling agent may be included in the slurry of abrasive particles and organic binder precursor; typically in an amount of from about 0.01 to 5 percent by weight, more typically in an amount of from about 0.01 to 3 percent by weight, more typically in an amount of from about 0.01 to 1 percent by weight, although other amounts may also be used, for example depending on the size of the abrasive particles. Suitable silane coupling agents include, for example, methacryloxypropylsilane, vinyltriethoxysilane, vinyltris(2-methoxyethoxy)silane, 3,4-epoxycyclohexylmethyltrimethoxysilane, γ-glycidoxypropyltrimethoxysilane, and γ-mercaptopropyltrimethoxysilane, allyltriethoxysilane, diallyldichlorosilane, divinyldiethoxysilane, and meta, para-styrylethyltrimethoxysilane, dimethyldiethoxysilane, dihydroxydiphenylsilane, triethoxysilane, trimethoxysilane, triethoxysilanol, 3-(2-aminoethylamino) propyltrimethoxysilane, methyltrimethoxysilane, vinyltriacetoxysilane, methyltriethoxysilane, tetraethyl orthosilicate, tetramethyl orthosilicate, ethyltriethoxysilane, amyltriethoxysilane, ethyltrichlorosilane, amyltrichlorosilane, phenyltrichlorosilane, phenyltriethoxysilane, methyltrichlorosilane, methyldichlorosilane, dimethyldichlorosilane, dimethyldiethoxysilane, and mixtures thereof.

The organic binder precursor (and hence also the organic binder) may optionally contain additives such as, for example, colorants, grinding aids, fillers, wetting agents, dispersing agents, light stabilizers, and antioxidants.

Grinding aids, which may optionally be included in the abrasive layer via the binder precursor, encompass a wide variety of different materials including both organic and inorganic compounds. A sampling of chemical compounds effective as grinding aids includes waxes, organic halide compounds, halide salts, metals and metal alloys. Specific waxes effective as a grinding aid include specifically, but not exclusively, the halogenated waxes tetrachloronaphthalene and pentachloronaphthalene. Other effective grinding aids include halogenated thermoplastics, sulfonated thermoplastics, waxes, halogenated waxes, sulfonated waxes, and mixtures thereof. Other organic materials effective as a grinding aid include specifically, but not exclusively, polyvinylchloride and polyvinylidene chloride. Examples of halide salts generally effective as a grinding aid include sodium chloride, potassium cryolite, sodium cryolite, ammonium cryolite, potassium tetrafluoroborate, sodium tetrafluoroborate, silicon fluorides, potassium chloride, and magnesium chloride. Halide salts employed as a grinding aid typically have an average particle size of less than 100 microns, with particles of less than 25 microns being preferred. Examples of metals generally effective as a grinding aid include antimony, bismuth, cadmium, cobalt, iron, lead, tin, and titanium. Other commonly used grinding aids include sulfur, organic sulfur compounds, graphite, and metallic sulfides. Combinations of these grinding aids can also be employed.

The abrasive particles should have sufficient hardness and surface roughness to function as abrasive particles in an abrading process. Preferably, the abrasive particles have a Mohs hardness of at least 4, at least 5, at least 6, at least 7, or even at least 8. Exemplary abrasive particles include crushed, shaped abrasive particles (e.g., shaped ceramic abrasive particles or shaped abrasive composite particles), and combinations thereof.

Examples of suitable abrasive particles include: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, Minn.; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide; quartz; feldspar; flint; emery; sol-gel-derived abrasive particles (e.g., including shaped and crushed forms); and combinations thereof. Further examples include shaped abrasive composites of abrasive particles in a binder matrix, such as those described in U.S. Pat. No. 5,152,917 (Pieper et al.). Many such abrasive particles, agglomerates, and composites are known in the art.

Examples of sol-gel-derived abrasive particles and methods for their preparation can be found in U.S. Pat. No.

4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the abrasive particles to the binder. The abrasive particles may be treated before combining them with the binder, or they may be surface treated in situ by including a coupling agent to the binder.

Preferably, the abrasive particles comprise ceramic abrasive particles such as, for example, sol-gel-derived polycrystalline alpha alumina particles. The abrasive particles may be crushed or shaped, or a combination thereof.

Shaped ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.). Alpha alumina-based shaped ceramic abrasive particles can be made according to well-known multistep processes. Briefly, the method comprises the steps of making either a seeded or non-seeded sol-gel alpha alumina precursor dispersion that can be converted into alpha alumina; filling one or more mold cavities having the desired outer shape of the shaped abrasive particle with the sol-gel, drying the sol-gel to form precursor shaped ceramic abrasive particles; removing the precursor shaped ceramic abrasive particles from the mold cavities; calcining the precursor shaped ceramic abrasive particles to form calcined, precursor shaped ceramic abrasive particles, and then sintering the calcined, precursor shaped ceramic abrasive particles to form shaped ceramic abrasive particles.

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

Although there is no particularly limitation on the shape of the shaped ceramic abrasive particles, the abrasive particles are preferably formed into a predetermined shape by shaping precursor particles comprising a ceramic precursor material (e.g., a boehmite sol-gel) using a mold, followed by sintering. The shaped ceramic abrasive particles may be shaped as, for example, pillars, pyramids, truncated pyramids (e.g., truncated triangular pyramids), and/or some other regular or irregular polygons. The abrasive particles may include a single kind of abrasive particles or an abrasive aggregate formed by two or more kinds of abrasive or an abrasive mixture of two or more kind of abrasives. In some embodiments, the shaped ceramic abrasive particles are precisely-shaped in that individual shaped ceramic abrasive particles will have a shape that is essentially the shape of the portion of the cavity of a mold or production tool in which the particle precursor was dried, prior to optional calcining and sintering.

Shaped ceramic abrasive particles used in the present disclosure can typically be made using tools (i.e., molds) cut using precision machining, which provides higher feature definition than other fabrication alternatives such as, for example, stamping or punching. Typically, the cavities in the tool surface have planar faces that meet along sharp edges, and form the sides and top of a truncated pyramid. The resultant shaped ceramic abrasive particles have a respective nominal average shape that corresponds to the shape of cavities (e.g., truncated pyramid) in the tool surface; however, variations (e.g., random variations) from the nominal average shape may occur during manufacture, and shaped ceramic abrasive particles exhibiting such variations are included within the definition of shaped ceramic abrasive particles as used herein.

In some embodiments, the base and the top of the shaped ceramic abrasive particles are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to shaped ceramic abrasive particles, the term "length" refers to the maximum dimension of a shaped abrasive particle. "Width" refers to the maximum dimension of the shaped abrasive particle that is perpendicular to the length. The terms "thickness" or "height" refer to the dimension of the shaped abrasive particle that is perpendicular to the length and width.

Preferably, the ceramic abrasive particles comprise shaped ceramic abrasive particles. Examples of sol-gel-derived shaped alpha alumina (i.e., ceramic) abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, then crushed to form shards that retain a portion of their original shape features. In some embodiments, sol-gel-derived shaped alpha alumina particles are precisely-shaped (i.e., the particles have shapes that are at least partially determined by the shapes of cavities in a production tool used to make them. Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

In some preferred embodiments, the abrasive particles comprise shaped ceramic abrasive particles (e.g., shaped sol-gel-derived polycrystalline alpha alumina particles) that are generally triangularly-shaped (e.g., a triangular prism or a truncated three-sided pyramid).

Shaped ceramic abrasive particles are typically selected to have a length in a range of from 1 micron to 15000 microns, more typically 10 microns to about 10000 microns, and still more typically from 150 to 2600 microns, although other lengths may also be used. In some embodiments, the length may be expressed as a fraction of the thickness of the bonded abrasive wheel in which it is contained. For example, the shaped abrasive particle may have a length greater than half the thickness of the bonded abrasive wheel. In some embodiments, the length may be greater than the thickness of the bonded abrasive cut-off wheel.

Shaped ceramic abrasive particles are typically selected to have a width in a range of from 0.1 micron to 3500 microns, more typically 100 microns to 3000 microns, and more typically 100 microns to 2600 microns, although other lengths may also be used.

Shaped ceramic abrasive particles are typically selected to have a thickness in a range of from 0.1 micron to 1600 microns, more typically from 1 micron to 1200 microns, although other thicknesses may be used.

In some embodiments, shaped ceramic abrasive particles may have an aspect ratio (length to thickness) of at least 2, 3, 4, 5, 6, or more.

Mesh abrasive products according to the present disclosure can be made, for example, by a method comprising the following sequential, and optionally consecutive, steps.

First, a production tool having a mold surface defining a plurality of shaped cavities is coated with an abrasive composite precursor slurry to fill the shaped cavities. The abrasive composite precursor slurry comprises abrasive particles dispersed within a curable binder precursor.

Next, the mold surface is contacted with an open mesh backing comprising interwoven threads defining openings, and having first and second opposed major sides.

Once in contact, the composite assembly is ultrasonically vibrated to ensure good coating of the threads by the abrasive composite precursor slurry.

Suitable ultrasonic devices are well-known in the art and may include, for example, commercially available sonication generators equipped with a horn, knife, blade, or plat. As used herein, the term "ultrasonic" refers to vibrational frequency above about 20,000 hertz. Examples of commercially available suitable ultrasonic devices include those available from Branson Ultrasonics, Danbury, Connecticut.

Next, the curable binder precursor is exposed to sufficient actinic electromagnetic radiation to cause curing. Suitable sources of actinic (e.g., ultraviolet and/or visible) electromagnetic radiation are well-known in the art and include, for example, low-, medium-, and/or high-pressure mercury lamps, lasers, microwave driven lamps, and xenon flash lamps. Exposure conditions will typically depend on the lamp type, intensity, and duration of exposure, and are within the capability of those skilled in the art.

Once cured, the production tool is removed, leaving behind and open mesh abrasive product comprising isolated shaped abrasive composites contacting and secured to the first major

SELECT EMBODIMENTS OF THE PRESENT DISCLOSURE

In a first embodiment, the present disclosure provides a method of making a mesh abrasive product, the method comprising sequentially:

providing a production tool having a mold surface defining a plurality of shaped cavities;

filling at least some of the shaped cavities with an abrasive composite precursor slurry, wherein the abrasive composite precursor slurry comprises abrasive particles dispersed within a curable binder precursor;

contacting the mold surface with an open mesh backing comprising interwoven threads defining openings, and having first and second opposed major sides;

ultrasonically vibrating the abrasive composite precursor slurry;

curing the curable binder precursor by exposing it to sufficient actinic electromagnetic radiation to provide isolated shaped abrasive composites contacting and secured to the first major side of the open mesh backing; and separating the mesh abrasive product from the production tool.

In a second embodiment, the present disclosure provides a method according to the first embodiment, wherein the threads have an average diameter, and wherein the openings have average length and width of 0.5 to 10 times the average diameter of the threads.

In a third embodiment, the present disclosure provides a method according to the first or second embodiment, wherein the curable binder precursor comprises a curable acrylic binder precursor.

In a fourth embodiment, the present disclosure provides a method according to any of the first to third embodiments, wherein the isolated shaped abrasive composites comprise at least one of triangular, square, rectangular, or hexagonal posts.

In a fifth embodiment, the present disclosure provides a method according to any of the first to fourth embodiments, wherein at least some of the isolated shaped abrasive composites contact at least six threads, preferably at least nine threads.

In a sixth embodiment, the present disclosure provides a method according to any of the first to fifth embodiments, wherein the open mesh backing further comprises an attachment layer secured to the second major side of the open mesh backing, wherein the attachment layer comprises either a looped portion or a hooked portion of a two-part hook and loop fastening system.

In a seventh embodiment, the present disclosure provides a method according to any of the first to sixth embodiments, wherein the isolated shaped abrasive composites do not contact the second major side.

In an eighth embodiment, the present disclosure provides a mesh abrasive product comprising:

an open mesh backing comprising interwoven threads defining openings, and having first and second opposed major sides; and a plurality of isolated shaped abrasive composites contacting and secured to the first major side, wherein the isolated shaped abrasive composites comprise abrasive particles dispersed in an organic binder, and wherein the isolated shaped abrasive composites do not contact each other.

In a ninth embodiment, the present disclosure provides a mesh abrasive product according to the eighth embodiment, wherein the threads have an average diameter, and wherein the openings have average length and width of 0.5 to 10 times the average diameter of the threads.

In a tenth embodiment, the present disclosure provides a mesh abrasive product according to the eighth or ninth embodiment, wherein at least a portion of each isolated abrasive composite comprises a shaped abrasive composite.

In an eleventh embodiment, the present disclosure provides a mesh abrasive product according to any of the eighth to tenth embodiments, wherein the organic binder comprises an acrylic binder.

In a twelfth embodiment, the present disclosure provides a mesh abrasive product according to any of the eighth to eleventh embodiments, wherein the isolated shaped abrasive composites comprise at least one of triangular, square, rectangular, or hexagonal posts.

In a thirteenth embodiment, the present disclosure provides a mesh abrasive product according to any of the eighth to twelfth embodiments, wherein at least some of the shaped abrasive composites contact at least six threads.

In a fourteenth embodiment, the present disclosure provides a mesh abrasive product according to any of the eighth to thirteenth embodiments, wherein at least some of the shaped abrasive composites contact at least nine threads.

In a fifteenth embodiment, the present disclosure provides a mesh abrasive product according to any of the eighth to fourteenth embodiments, wherein the isolated shaped abrasive composites do not contact the second major side.

In a sixteenth embodiment, the present disclosure provides a mesh abrasive product according to any of the eighth to fifteenth embodiments, further comprising an attachment layer secured to the second major side of the open mesh backing, wherein the attachment layer comprises either a looped portion or a hooked portion of a two-part hook and loop fastening system.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Digital micrographs of the Examples were obtained using a KEYENCE optical microscope, model VK-5000 available from Keyence Corp., Osaka, Japan TABLE 1, below, reports materials used in the Examples.

TABLE 1

| DESIGNATION | DESCRIPTION |
|---|---|
| SR368 | tris(2-hydroxyethyl)isocyanurate triacrylate, available from Sartomer Co., Exton, Pennsylvania |
| IRGACURE 369 | 2-benzyl-2-dimethylamino-1-(4-morpholinophenyl)-butanone-1 photoinitiator available from BASF Corp., Florham Park, New Jersey |
| SILANE A174 | 3-(trimethoxysilyl)propyl methacrylate, available as Silane A174 from Sigma-Aldrich Corp., St. Louis, Missouri |
| OX50 | AEROSIL OX 50, fumed silica, chemically prepared by Evonik Corporation USA, Parsippany, New Jersey |
| KBF4 | potassium fluoroborate, supplied by AWSM Industries, Paramus, New Jersey |
| SAP | SAP are precision shaped abrasive particles. Examples of SAP were described in U.S. Pat. No. 8,142,531 (Adefris et al), and U.S. Pat. application No. 2015/0267097 A1 (Rosenflanz et al). The shaped abrasive particles were prepared by molding the ceramic precursor pre-Mix in equilateral triangle-shaped polypropylene mold cavities. After drying, the precursor particles were released from the mold and converted to abrasive particles through sintering and firing the precursor particles. The size of the SAP particles used in the examples and comparative examples was P220 grade triangle shaped abrasive grains |
| AO | P220 alpha alumina crushed abrasive grains available from Imerys, Paris, France. |
| PREMIX | The premix contained 56 parts SR368 resin with 1% Irgacure 369, 40 parts KBF4, 2 parts A-174 silane coupling agent and 2 parts OX50 filler. The premix was stirred with a high-speed shear mixer (Hei-TORQUE Precision 200 Overhead Stirrer, Heidolph, Schwabach, Germany) at 600 RPM for 10 minutes |
| ABRASIVE SLURRY | 100 grams of slurry were made by blending 42 parts premix and 58 parts abrasive mineral under high speed shear (Hei-TORQUE Precision 200 Overhead Stirrers) at 600 RPM for 10 minutes |
| MESH BACKING | mesh backing having loops on one side, 150 grams per square meter, available as GR150 H100 available from SitiP, S.p.A., Cene, Italy. |
| Keyence | Optical microscope, VK-5000 available from Keyence Corp., Osaka, Japan |

General Procedure of Making Structured Mesh Abrasive Articles:

A production tool is used to make structured abrasives with precision shape and distributions on the mesh backing. A production tool having a plurality of precisely shaped recesses is coated with an abrasive slurry in order to fill the precisely shaped recesses. The front surface of the backing is then brought into contact with the abrasive slurry. To promote the contact between the slurry and the mesh backing, an ultrasonication was applied onto either the production tool or the mesh backing for 5-20 seconds. With aid of sonication vibration, the yarns of the mesh backing wicked the wet slurry sitting in the cavities to form a contact between the slurry and the yarns. While in contact, the abrasive slurry is exposed to actinic radiation for 5-20 seconds that sufficient to at least partially cure or solidify the binder precursor of the abrasive slurry. Optionally, additional cure can be applied to secure the contact between the slurry and the yarns of the mesh backing. For example, the sample was further cured by passing through actinic radiation with the mesh backing facing the actinic radiation source. Finally, the backing having the abrasive coating bonded thereon is removed from the mold surface of the production tool to yield a mesh abrasive article.

Comparative Example A

A production tool having close-packed hexagonal shaped cavities was used to make Comparative Example A. The hexagon cavities were evenly distributed into the mold cavities on the mold surface of the production tool and had a side length of 3500 microns, a depth of 450 microns and a wall thickness between cavities of 2000 microns.

ABRASIVE SLURRY was coated into the tooling using a tongue depressor to fill the openings in the production tool. ABRASIVE SLURRY (110.3 g) was applied onto a 9 in×11 in (23 cm×28 cm) surface area on the production tool to fill all the cavities. MESH BACKING was taped onto the coated tool surface with 2-in (5.1 cm) wide masking tape with the no-loop side facing the tool surface. The MESH BACKING was nipped with a rub roller in order to laminate the mesh backing onto the slurry on the surface of the production tool. The mesh together with the tool was cured by passing through a model #DRE 410 Q UV-curing chamber (Fusion UV Systems, Gaithersburg, Maryland) equipped with two 600 watt "D-type" Fusion lamps set on high power. The production tool was then separated from the MESH BACKING, whereby the cured shaped abrasive composites remained in the production tool cavities and did not adhere to the MESH BACKING.

Comparative Example B

Figure 2:
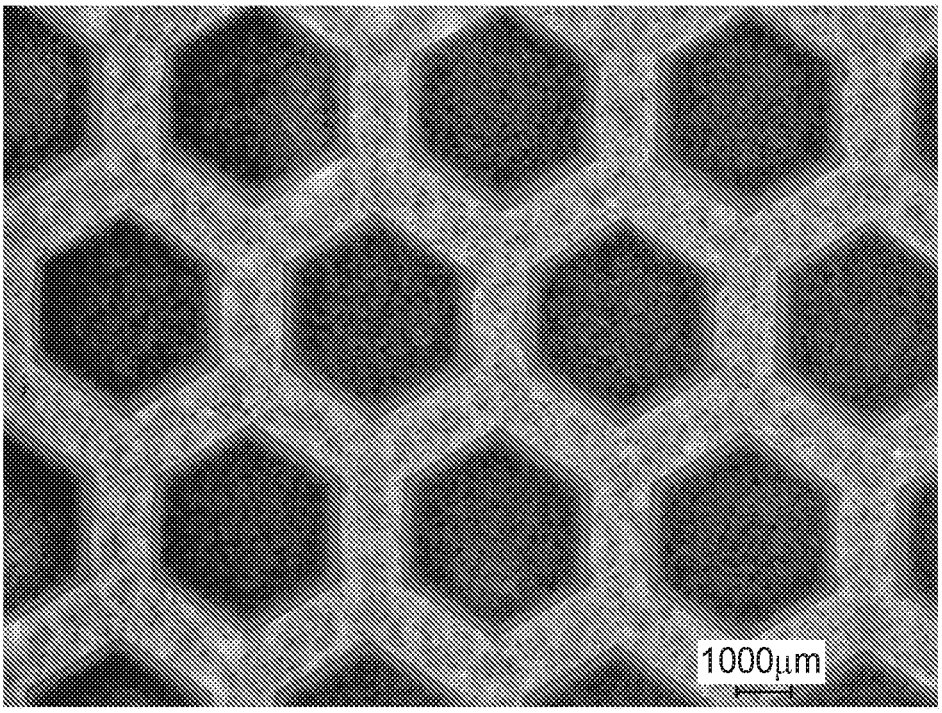
FIG. 2 is a digital micrograph of a mesh abrasive product made in Comparative Example B.

The procedure of Comparative Example A was repeated, except that 160.8 g of SLURRY applied onto a 9 in ×11 in (23 cm×28 cm) surface area on the production tool to fill all the cavities. Excess amount of slurry was applied onto the tool to provide a slight excess land area to facilitate abrasive coating transfer. After UV-curing, the production tool was separated from the MESH BACKING to obtain cured structured abrasive composites secured to the MESH BACKING; however, cured abrasive composite covered all the openings of the MESH BACKING between shaped abrasive composites. A digital micrograph of the abrasive side of the structured mesh abrasive made in Comparative Example B is shown in FIG. 2.

Example 1

Figure 3:
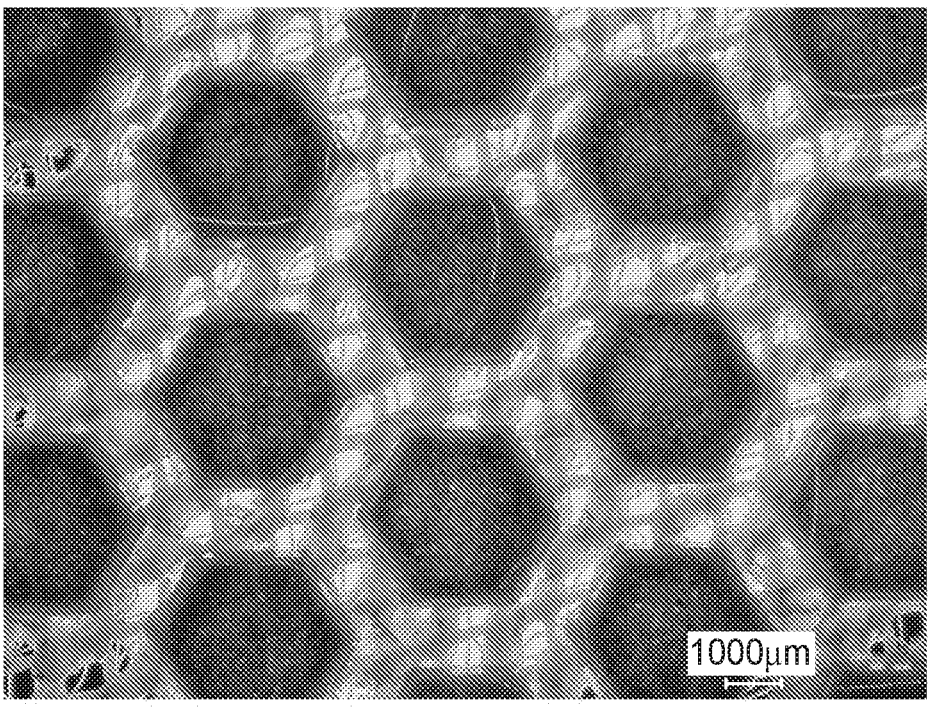
FIG. 3 is a digital micrograph of a mesh abrasive product made in Example 1.

The procedure of Comparative Example A was repeated, excepted that after the MESH BACKING was taped to the production tool, the combined assembly was nipped with an ultrasonic horn. The horn was oscillated at a frequency of 19100 Hz at an amplitude of about 130 micrometers. The horn was composed of 6-4 titanium and was driven with a 900 watt 184V Branson power source coupled with a 2:1 Booster 802 piezoelectric converter. After passing the ultrasonic horn, the MESH BACKING together with the tool were cured in the UV-curing chamber. After UV cure, the production tool was separated from the MESH BACKING to obtain a mesh abrasive product having isolated shaped abrasive composites adhered to the MESH BACKING. All of the cured abrasive slurry was successfully transferred onto the mesh backing, and all the openings on the mesh backing between the hexagons remained substantially open. A digital micrograph of the abrasive side of the structured mesh abrasive made in EXAMPLE 1 is shown in FIG. 3.

Example 2

Figure 4A:
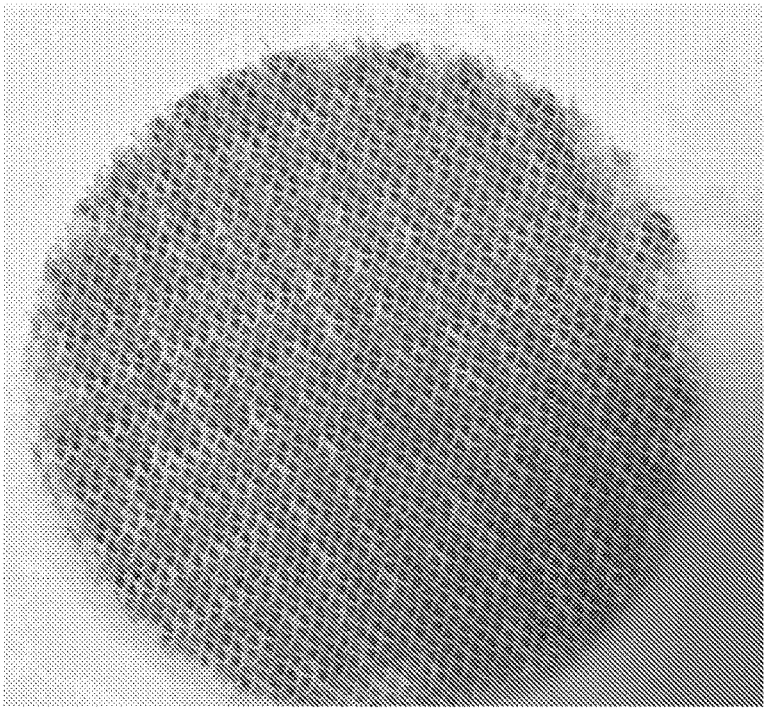
FIG. 4A is a digital micrograph of the looped side of the mesh abrasive disc made in Example 2.
Figure 4B:
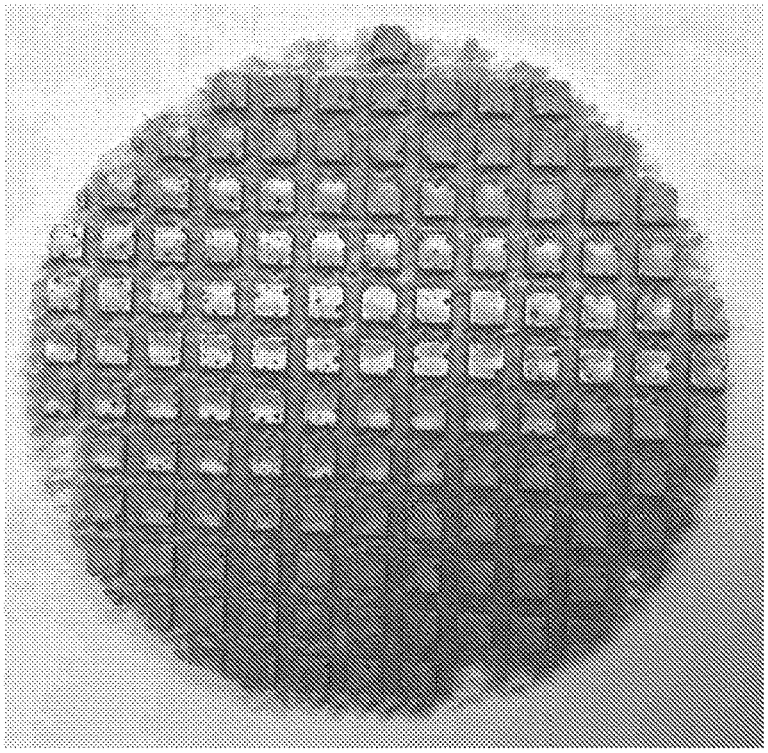
FIG. 4B is a digital micrograph of the abrasive side of the mesh abrasive disc made in Example 2.
Figure 4C:
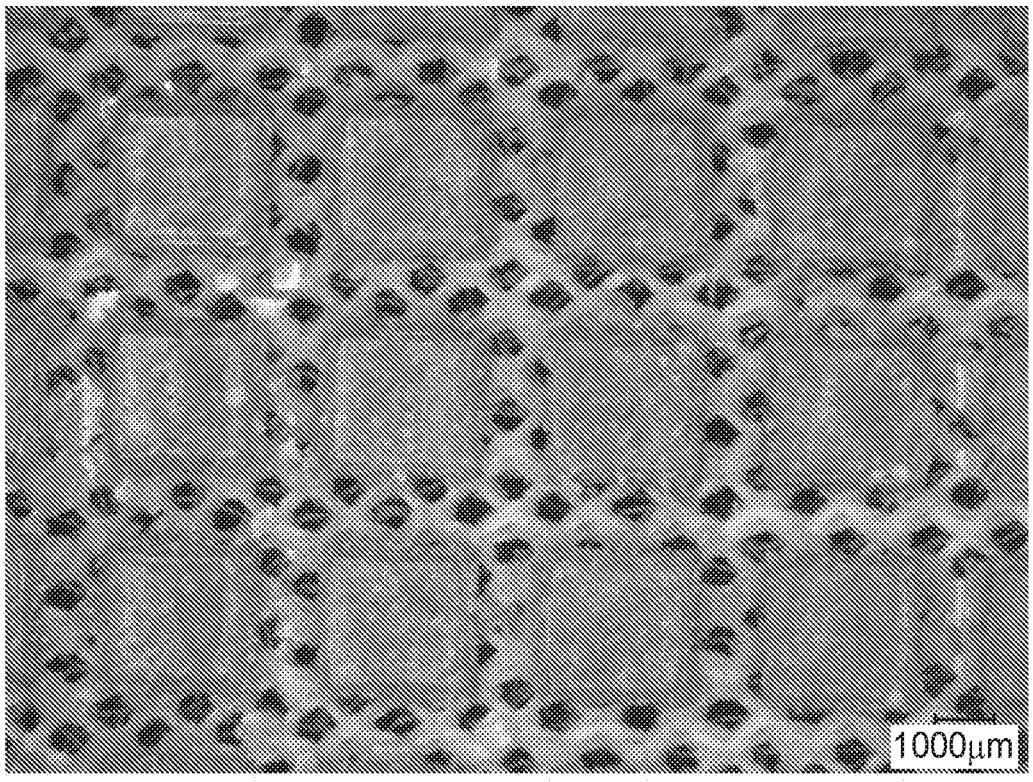
FIG. 4C is a higher resolution digital micrograph of the abrasive side of the mesh abrasive disc made in Example 2.

The procedure of Example 1 was repeated, except that: (1) a production tool with close-packed square-shaped mold cavities was used (side length of 3600 microns, a depth of 500 microns, and a wall thickness between cavities of 2500 microns); and (2) a blend mineral of 10 parts P220 grade SAP and 90 parts P220 grade AO was used. FIGS. 4A and 4B show images of the loop side and abrasive side, respectively, of a 3.5-inch (8.9-cm) mesh abrasive disc made according to Example 2. FIG. 4C shows an enlarged view of FIG. 4B.

All cited references, patents, and patent applications in this application are incorporated by reference in a consistent manner. In the event of inconsistencies or contradictions between portions of the incorporated references and this application, the information in this application shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making a mesh abrasive product, the method comprising sequentially:

providing a production tool having a mold surface defining a plurality of shaped cavities;

filling at least some of the shaped cavities with an abrasive composite precursor slurry, wherein the abrasive composite precursor slurry comprises abrasive particles dispersed within a curable binder precursor;

contacting the mold surface with an open mesh backing comprising interwoven threads defining openings, and having first and second opposed major sides;

ultrasonically vibrating the abrasive composite precursor slurry;

curing the curable binder precursor by exposing it to sufficient actinic electromagnetic radiation to provide isolated shaped abrasive composites contacting and secured to the first major side of the open mesh backing; and separating the mesh abrasive product from the production tool.

2. The method of claim 1, wherein the threads have an average diameter, and wherein the openings have average length and width of 0.5 to 10 times the average diameter of the threads.

3. The method of claim 1, wherein the curable binder precursor comprises a curable acrylic binder precursor.

4. The method of claim 1, wherein the isolated shaped abrasive composites comprise at least one of triangular, square, rectangular, or hexagonal posts.

5. The method of claim 1, wherein at least some of the isolated shaped abrasive composites contact at least six threads.

6. The method of claim 1, wherein the open mesh backing further comprises an attachment layer secured to the second major side of the open mesh backing, wherein the attachment layer comprises either a looped portion or a hooked portion of a two-part hook and loop fastening system.

7. The method of claim 1, wherein the isolated shaped abrasive composites do not contact the second major side.

8. The method of claim 1, wherein at least some of the isolated shaped abrasive composites contact at least nine threads.

9. The method of claim 2, wherein the curable binder precursor comprises a curable acrylic binder precursor.

10. The method of claim 2, wherein the isolated shaped abrasive composites comprise at least one of triangular, square, rectangular, or hexagonal posts.

11. The method of claim 2, wherein at least some of the isolated shaped abrasive composites contact at least six threads.

12. The method of claim 2, wherein at least some of the isolated shaped abrasive composites contact at least nine threads.

13. The method of claim 2, wherein the open mesh backing further comprises an attachment layer secured to the second major side of the open mesh backing, wherein the attachment layer comprises either a looped portion or a hooked portion of a two-part hook and loop fastening system.

14. The method of claim 2, wherein the isolated shaped abrasive composites do not contact the second major side.

15. The method of claim 5, wherein the curable binder precursor comprises a curable acrylic binder precursor.

16. The method of claim 5, wherein the isolated shaped abrasive composites comprise at least one of triangular, square, rectangular, or hexagonal posts.

17. The method of claim 5, wherein the open mesh backing further comprises an attachment layer secured to the second major side of the open mesh backing, wherein the attachment layer comprises either a looped portion or a hooked portion of a two-part hook and loop fastening system.

18. The method of claim 5, wherein the isolated shaped abrasive composites do not contact the second major side.

19. The method of claim 5, wherein at least some of the isolated shaped abrasive composites contact at least nine threads.

* * * * *